US008525636B1

(12) United States Patent
Sha et al.

(10) Patent No.: US 8,525,636 B1
(45) Date of Patent: Sep. 3, 2013

(54) THERMISTOR

(75) Inventors: Yi An Sha, Xindian (TW); Kuo Chang Lo, New Taipei (TW); Tsungmin Su, Hsinchu (TW)

(73) Assignee: Polytronics Technology Corp., Hsinchu (TW)

( * ) Notice: Subject to any disclaimer, the term of this patent is extended or adjusted under 35 U.S.C. 154(b) by 0 days.

(21) Appl. No.: 13/439,331

(22) Filed: Apr. 4, 2012

(51) Int. Cl.
*H01C 7/10* (2006.01)

(52) U.S. Cl.
USPC ..... 338/22 R; 338/332

(58) Field of Classification Search
USPC ..... 338/22 R, 332
See application file for complete search history.

(56) References Cited

U.S. PATENT DOCUMENTS 5,900,800 A * 5/1999 McGuire et al. ..... 338/22 R
6,377,467 B1 * 4/2002 Chu et al. ..... 361/767
6,452,476 B1 * 9/2002 Handa ..... 338/22 R
7,286,038 B1 * 10/2007 Wang et al. ..... 338/22 R
2002/0093007 A1 * 7/2002 Handa et al. ..... 252/500
2004/0041683 A1 * 3/2004 Tosaka et al. ..... 338/22 R

* cited by examiner

*Primary Examiner* — Kyung Lee

(74) *Attorney, Agent, or Firm* — Egbert Law Offices, PLLC

(57) ABSTRACT

A thermistor includes a first electrically conductive member, a second electrically conductive member and a polymer material layer laminated therebetween. The polymer material layer exhibits positive temperature coefficient (PTC) behavior, and includes at least one crystalline polymer and at least one electrically conductive filler distributed in the crystalline polymer. The conductive filler has a resistivity less than 500 μΩ-cm and includes 72-96% by weight of the polymer material layer. The thermistor has a device effective area, and the value of the hold current at 60° C. divided by the device effective area is around 0.16-0.8 A/mm$^2$. The ratio of the hold current of the thermistor at 60° C. to the hold current at 25° C. of the thermistor is 40-95%.

19 Claims, 2 Drawing Sheets

THERMISTOR

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a thermistor, and more particularly to a thermistor with high hold current value at high temperature.

2. Description of Related Art Including Information Disclosed Under 37 CFR 1.97 and 37 CFR 1.98.

Because the resistance of conductive composite materials having a positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g., at least $10^2\Omega$), so as to suppress over-current and protect the cell or the circuit device.

PTC conductive composite material may include one or more crystalline polymers and conductive filler. The polymer may be usually polyolefin such as polyethylene, while the conductive filler may be carbon black. However, PTC conductive composite material having carbon black cannot obtain high hold current due to insufficient thermal mass and high resistance. When temperature rises, the hold current of the PTC conductive composite material will be tremendously decreased. Therefore, it cannot meet the requirements for protection to large-current secondary batteries.

BRIEF SUMMARY OF THE INVENTION

To overcome the shortcomings of low hold current of the PTC device having carbon black, in accordance with the present application, different conductive fillers and compositions are used to sustain high hold current at high temperature. The thermistor of the present application can be associated with secondary battery circuit design and satisfy the need to protect large-current secondary batteries.

In accordance with an embodiment of the present application, a thermistor includes a first electrically conductive member, a second electrically conductive member and a polymeric material layer. The polymeric material layer is laminated between the electrically conductive members, and exhibits PTC behavior. The polymeric material layer includes at least one crystalline polymer and at least one conductive filler dispersed in the crystalline polymer. The resistivity of the conductive filler is less than 500 μΩ-cm, and the conductive filler may include 72-96% by weight of the polymeric material layer. The thermistor has a device effective area, and a value of the hold current thereof at 60° C. divided by the device effective area is around 0.16-0.8 A/mm$^2$. The ratio of the hold current of the thermistor at 60° C. to the hold current of the thermistor at 25° C. is around 40-95%.

In an embodiment, the thermal cut-off (TCO) temperature corresponding to the hold current of the thermistor at 60° C. is less than 95° C. Nevertheless, in practice, the above TCO temperature is not restricted to the basis of the hold current at 60° C. The TCO temperature may be alternatively defined as follows: The TCO temperature on a basis of the hold current of the thermistor at a temperature T is less than T+35° C., where T≧60° C.

In an embodiment, one or more thermistors of the present application may be coupled to a protective circuit module (PCM) and secondary batteries in series or in parallel by spot-welding, reflow, supersonic welding or laser welding.

BRIEF DESCRIPTION OF THE SEVERAL VIEWS OF THE DRAWINGS

The present application will be described according to the appended drawings in which.

DETAILED DESCRIPTION OF THE INVENTION

Figure 1:
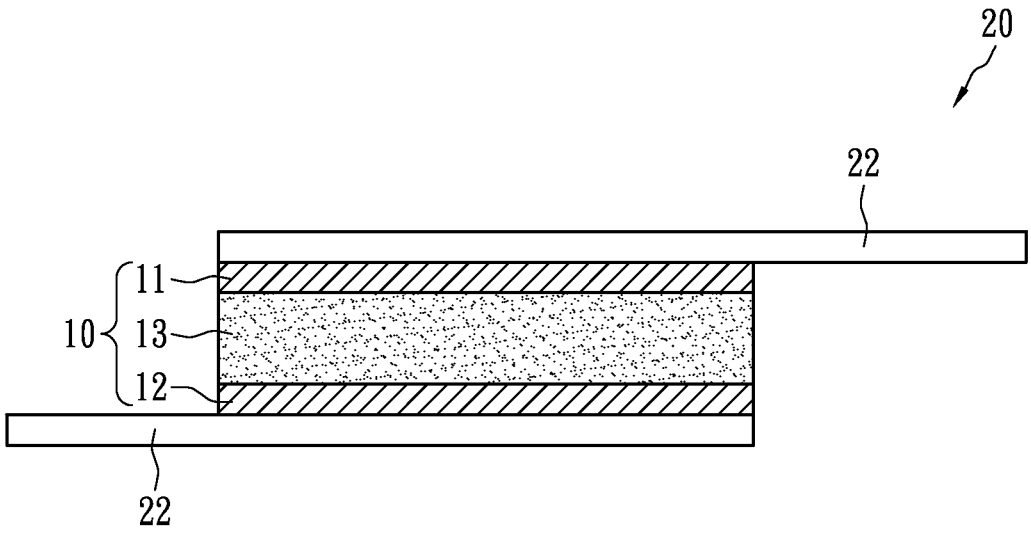
FIG. 1 shows a thermistor in accordance with an embodiment of the present application.

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

The composition and weight (unit: gram) of the polymeric material layer of the thermistor of the present application is shown in Table 1. LDPE-1 is low-density crystalline polyethylene of a density 0.924 g/cm$^3$ and a melting point 113° C. HDPE-1 is high-density crystalline polyethylene of a density 0.943 g/cm$^3$ and a melting point 125° C. HDPE-2 is high density crystalline polyethylene of a density 0.961 g/cm$^3$ and a melting point 131° C. The conductive filler may use titanium carbide (TiC), tungsten carbide or molybdenum carbide ($Mo_2C$). In an embodiment, the conductive filler includes 72-96%, and particularly 75-94% or 78-92%, by weight of the polymeric material layer. The conductive filler may include 74%, 78%, 80%, 85% or 90% by weight of the polymeric material layer. LDPE-1 includes less than 18%, or particularly less than 10%, 8%, 5% or 3%, by weight of the polymeric material layer. The HDPE-1 and HDPE-2 in total is 3-25%, and particularly 5-20%, by weight of the polymeric material layer. In an embodiment, HDPE-1 of lower density includes less than 20% by weight of the polymeric material layer, while HDPE-2 of higher density includes less than 20% by weight of the polymeric material layer. The melting points of HDPE-1 and HDPE-2 are both larger than 115° C.

TABLE 1

| Material | LDPE-1 | HDPE-1 | HDPE-2 | TiC | WC | $Mo_2C$ | Carbon Black | Conductive filler (wt %) |
|---|---|---|---|---|---|---|---|---|
| Em. 1 | 4 | 13.4 | — | 112- | — | — | — | 86% |
| Em. 2 | 3.6 | 12.8 | — | 120- | — | — | — | 88% |
| Em. 3 | 3 | 9 | 4 | 125 | — | — | — | 89% |
| Em. 4 | 2 | 11.4 | 3 | 130 | — | — | — | 89% |
| Em. 5 | — | 11.5 | 3.5 | 128 | — | — | — | 90% |
| Em. 6 | 2.7 | 21.5 | — | 85 | — | — | — | 77% |
| Em. 7 | 1.8 | — | 21.2 | 100 | — | — | — | 81% |
| Em. 8 | 2 | — | 17.7 | — | — | 193 | — | 91% |
| Em. 9 | 3.1 | 17.3 | — | — | 280 | — | — | 93% |
| Em. 10 | 2.1 | — | 16 | — | 300 | — | — | 94% |
| Em. 11 | 11.5 | — | 6 | 90 | — | — | — | 83% |
| Em. 12 | 21.9 | — | — | 100 | — | — | — | 82% |
| Comp. 1 | 7.7 | 19.2 | — | — | — | — | 22 | 45% |
| Comp. 2 | 10.9 | — | 14.3 | — | — | — | 31.6 | 56% |

In an embodiment, the manufacturing process of the thermistor is described as follows. The raw material is fed into a blender (HAAKE 600) at 160° C. for two minutes. The procedure of feeding the raw material includes adding the crystalline polymers with the amounts according to Table 1 into the blender; after blending for a few seconds, then adding the conductive ceramic carbide filler, e.g., titanium carbide, tungsten carbide or molybdenum carbide, with particle size distribution between 0.1 μm and 50 μm. The rotational speed of the blender is set at 40 rpm. After blending for three minutes, the rotational speed is increased to 70 rpm. After blending for 7 minutes, the mixture in the blender is drained and thereby a conductive composition with PTC characteristic is formed.

The above conductive composition is loaded symmetrically into a mold with outer steel plates and a 0.33 mm and 0.2 mm thick middle, wherein the top and the bottom of the mold are disposed with a Teflon cloth. The mold loaded with the conductive composition is pre-pressed for three minutes at 50 kg/cm$^2$, 180° C. Then the generated gas is exhausted and the mold is pressed for 3 minutes at 100 kg/cm2, 180° C. Next, the press step is repeated once at 150 kg/cm$^2$ and 180° C. for three minutes to form a PTC material layer. In an embodiment, the thickness of the PTC material layer is greater than 0.1 mm, or preferably greater than 0.2 mm or 0.3 mm.

The PTC material layer is cut into many pieces each with an area of 20×20 cm$^2$. Then two metal foils physically contact the top surface and the bottom surface of the PTC material layer, in which the two metal foils are symmetrically placed upon the top surface and the bottom surface of the PTC material layer. Next, Teflon cloths and the steel plates are placed on the metal foils and are pressed to form a multi-layered structure. Next, the multi-layered structure is punched or cut to form a thermistor 10 with an area less than 25 mm$^2$, or preferably less than 20 mm$^2$.

More specifically, the thermistor 10 includes a first electrically conductive member 11, a second electrically conductive member 12, and a polymeric material layer 13, those are equivalent to the aforesaid metal foils and the PTC material layer. The weight ratio of the polymeric material layer 13 to the crystalline polymer with same volume (i.e., the density ratio) is between 2.5 and 12, or between 3 and 10 in particular.

In an embodiment, two metal electrode sheets 22 are jointed to the electrically conductive members 11 and 12 by solder reflow to form an axial-leaded over-current protection device 20.

In addition to the materials listed in Table 1, the polymeric material layer may use crystalline polyolefines (e.g., high-density polyethylene (HDPE), medium-density polyethylene, low-density polyethylene (LDPE), polyvinyl wax, vinyl polymer, polypropylene, polyvinyl chlorine and polyvinyl fluoride), copolymer of olefin monomer and acrylic monomer (e.g., copolymer of ethylene and acrylic acid or copolymer of ethylene and acrylic resin) or copolymer of olefin monomer and vinyl alcohol monomer (e.g., copolymer of ethylene and vinyl alcohol), and may include one or more crystalline polymer materials. The LDPE can be polymerized using Ziegler-Natta catalyst, Metallocene catalyst or the like, or can be copolymerized by vinyl monomer and other monomers such as butane, hexane, octane, acrylic acid, or vinyl acetate.

The conductive filler may be metal powder or conductive ceramic carbide powder. The metal powder may include nickel, cobalt, copper, iron, tin, lead, silver, gold, platinum, vanadium or the alloy thereof. The conductive ceramic carbide powder may include titanium carbide, tungsten carbide, vanadium carbide, boron carbide, zirconium carbide, niobium carbide, tantalum carbide, molybdenum carbide, hafnium carbide or the mixture thereof, and may be of various shapes, e.g., spherical, debris, flake, or polygonal shape. The particle size of the conductive ceramic carbide filler is essentially between 0.1 μm and 50 μm.

TABLE 2

| | Device effective area (mm) | I-hold @ 25° C. (A) | I-hold @ 60° C. (A) | I-hold @ 70° C. (A) | I-hold @ 60° C./device effective area (A/mm$^2$) | I-hold @ 60° C./I-hold @ 25° C. |
|---|---|---|---|---|---|---|
| Em. 1 | 2.8 × 3.5 | 3.5 | 2.4 | 1.7 | 0.244 | 68% |
| Em. 2 | 2.8 × 3.5 | 4.4 | 3.3 | 2.7 | 0.336 | 75% |
| Em. 3 | 2.8 × 3.5 | 4.4 | 3.0 | — | 0.306 | 68% |
| Em. 4 | 2.8 × 3.5 | 4.7 | 3.5 | 2.8 | 0.357 | 74% |
| Em. 5 | 2.8 × 3.5 | 5.2 | 4.6 | 4.0 | 0.469 | 88% |

TABLE 2-continued

| | Device effective area (mm) | I-hold @ 25° C. (A) | I-hold @ 60° C. (A) | I-hold @ 70° C. (A) | I-hold @ 60° C./device effective area (A/mm$^2$) | I-hold @ 60° C./I-hold @ 25° C. |
|---|---|---|---|---|---|---|
| Em. 6 | 2.8 × 3.5 | 2.5 | 1.8 | — | 0.183 | 72% |
| Em. 7 | 2.8 × 3.5 | 2.9 | 2.3 | — | 0.234 | 79% |
| Em. 8 | 3 × 5 | 4.3 | 2.8 | — | 0.186 | 65% |
| Em. 9 | 3 × 5 | 5.4 | 3.7 | — | 0.246 | 68% |
| Em. 10 | 3 × 5 | 6.8 | 5.1 | — | 0.340 | 75% |
| Em. 11 | 3 × 5 | 4.5 | 2.2 | — | 0.146 | 48% |
| Em. 12 | 3 × 5 | 3.8 | 1.6 | — | 0.106 | 42% |
| Comp. 1 | 4.2 × 4.4 | 0.55 | 0.1 | — | 0.005 | 18% |
| Comp. 2 | 4.2 × 4.4 | 1.3 | .33 | — | 0.017 | 25% |

The thermistor 10 undergoes hold current (I-hold) test at 25° C., 60° C. and 70° C., respectively, and the results of twelve embodiments (Em. 1-Em. 12) and two comparative examples (Comp. 1 and Comp. 2) are shown in Table 2. The hold current is the maximum current at which the thermistor 10 does not trip at a predetermined temperature. The volume resistivity (ρ) of the polymeric material layer 13 can be calculated by formula (1) below, where R, A, and L indicate the resistance, the area, and the thickness of the polymeric material layer 13, respectively. In this embodiment, the thermistor 10 has a device effective area that is the effective cross-sectional area of current path of the polymeric material layer 13, e.g., the area A. For example, the device effective area of Em. 1 is 2.8×3.5=9.8 mm$^2$.

$$\rho = \frac{R \times A}{L} \tag{1}$$

At 60° C., the value of I-hold divided by device effective area is around 0.16-0.8 A/mm$^2$, particularly 0.18-0.75 A/mm$^2$ or 0.2-0.7 A/mm$^2$. Moreover, at 60° C., the value of I-hold divided by device effective area may be 0.3 A/mm$^2$, 0.4 A/mm$^2$, 0.5 A/mm$^2$ or 0.6 A/mm$^2$. Theoretically, the smaller the device effective area, the larger the hold current is. Therefore, the device area of the thermistor 10 is preferably smaller than 25 mm$^2$. The values of I-hold/device effective area of Comp. 1 and Comp. 2 using carbon black are smaller than 0.05 A/mm$^2$, and thus they are not suitable for large-current applications.

Figure 2:
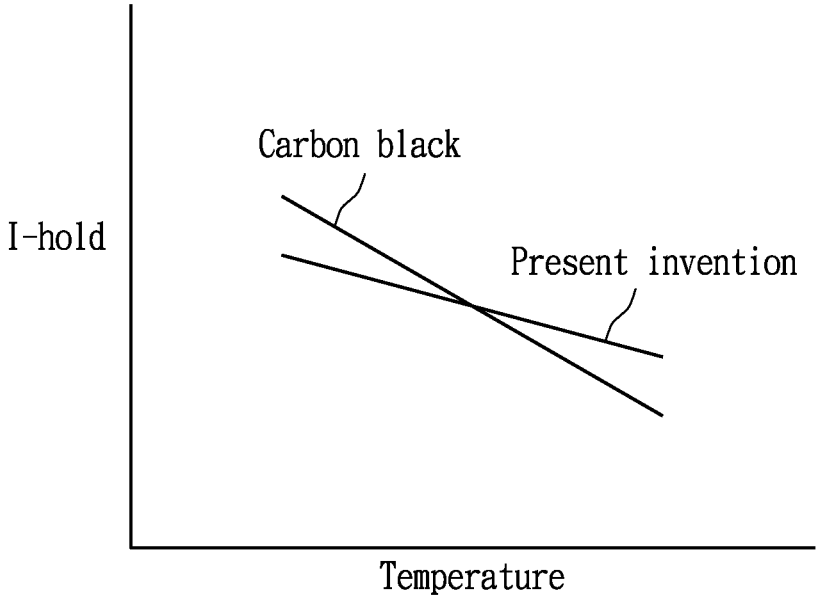
FIG. 2 shows the hold current of a thermistor vs. temperature relationship.

The ratios of I-hold@60° C. to I-hold@25° C. of all embodiments are about 40%-95%, and particularly 60-90%, or 70-85%. Such ratios may include 45%, 50%, 55%, 65% or 70%. However, the ratios of I-hold@60° C. to I-hold@25° C. of Comp. 1 and Comp. 2 are below 30%. In other words, in comparison with those using carbon black, the hold current of the thermistor 10 of the present application is decreased slowly as temperature rises, as shown in FIG. 2. As a result, the thermistor 10 of the present application can sustain relatively high hold current at high temperature.

The thermistor 10 may further undergo thermal cut-off (TCO) temperature test. The thermistor 10 is placed in an oven and the hold current at a temperature is applied to the thermistor 10. TCO temperature is a temperature at which the thermistor is tripped and the current flowing therethrough is tremendously diminished during the process that temperature in the oven gradually increases. In an embodiment, TCO temperatures are tested on a basis of hold current at 60° C., and the results are shown in Table 3 below.

TABLE 3

| | Device effective area (mm) | I-hold @ 60° C. (A) | TCO @ 60° C. I-hold (° C.) |
|---|---|---|---|
| Em. 1 | 2.8 × 3.5 | 2.4 | 72 |
| Em. 2 | 2.8 × 3.5 | 3.3 | 77 |
| Em. 3 | 2.8 × 3.5 | 3.0 | 70 |
| Em. 4 | 2.8 × 3.5 | 3.5 | 78 |
| Em. 5 | 2.8 × 3.5 | 4.6 | 76 |
| Em. 6 | 2.8 × 3.5 | 1.8 | 66 |
| Em. 7 | 2.8 × 3.5 | 2.3 | 70 |
| Em. 8 | 3 × 5 | 2.8 | 80 |
| Em. 9 | 3 × 5 | 3.7 | 81 |
| Em. 10 | 3 × 5 | 5.1 | 79 |
| Em. 11 | 3 × 5 | 2.2 | 77 |
| Em. 12 | 3 × 5 | 1.6 | 76 |
| Comp. 1 | 4.2 × 4.4 | 0.1 | 71 |
| Comp. 2 | 4.2 × 4.4 | .33 | 78 |

On a basis of hold current at 60° C., TCO temperatures for all embodiments are less than 95° C., or particularly less than 90° C. or 85° C. More specifically, the TCO temperatures on a basis of hold current at 60° C. are in the range of 60° C.-95° C., and 65° C.-85° C. in particular. In practice, TCO temperatures may be measured on a basis of hold current at a temperature greater than 60° C. As such, the TCO temperature on a basis of the hold current of the thermistor at a temperature T is less than T+35° C., wherein T≧60° C.

The thermistor 10 can be used for protecting secondary batteries, as the illustrative embodiments below.

Figure 3:
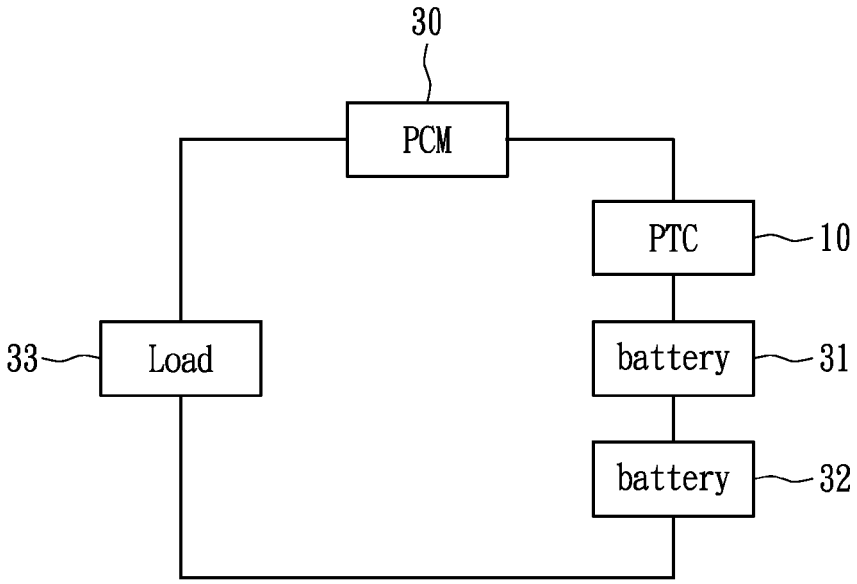
FIG. 3 shows an embodiment of a thermisitor associated with secondary batteries in accordance with the present application.

In FIG. 3, the thermistor 10 can be secured on a protective circuit module (PCM) 30 and coupled to the PCM in series. The thermistor 10 is further connected to the secondary batteries 31 and 32 and a load 33 in series to form a loop, so that the thermistor 10 can instantly decrease the current flowing therethrough to protect the secondary batteries 31 and 32 when over-current occurs. In an embodiment, the thermistor 10 may be electrically connected to the secondary batteries 31 and 32 and PCM 30 by spot-welding, reflow, supersonic welding or laser welding.

Figure 4:
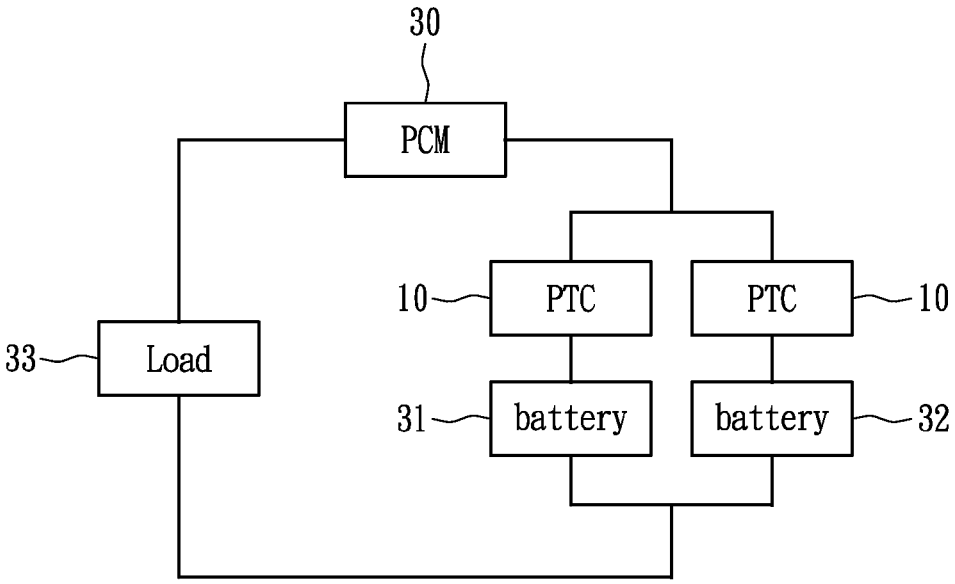
FIG. 4 shows another embodiment of thermistors associated with secondary batteries in accordance with the present application.

In FIG. 4, the secondary batteries 31 and 32 are connected in parallel, and each of them is connected to a thermistor 10, thereby providing over-current protection to large-current applications. In an embodiment, the thermistors 10 may be electrically connected to the secondary batteries 31, 32 and PCM 30 by spot-welding, reflow, supersonic welding or laser welding.

In summary, the hold current of the thermistor of the present application is less sensitive to temperature variation. That is, the decrease of the hold current is mitigated as temperature rises; thus the thermistor can sustain high hold current at a high temperature. Therefore, the thermistor of the present application can be introduced to secondary battery circuit design to meet the requirement of over-current protection for large-current secondary batteries.

The above-described embodiments of the present invention are intended to be illustrative only. Numerous alternative embodiments may be devised by persons skilled in the art without departing from the scope of the following claims.

We claim:

1. A thermistor comprising:

a first electrically conductive member;

a second electrically conductive member; and a polymeric material layer laminated between the first electrically conductive member and the second electrically conductive member, the polymeric material layer exhibiting positive temperature coefficient behavior, the polymeric material layer comprising at least one crystalline polymer and at least one conductive filler dispersed in the crystalline polymer, wherein the conductive filler has a resistivity less than 500 Ω-cm, and comprises 72-96% by weight of the polymeric material layer;

wherein the thermistor has a device effective area, the value of a hold current of the thermistor at 60° C. divided by the device effective area is between 0.2 A/mm$^2$ and 0.8 A/mm$^2$;

wherein a ratio of the hold current of the thermistor at 60° C. to a hold current of the thermistor at 25° C. is between 40% and 95%.

2. The thermistor of claim 1, wherein a TCO temperature on a basis of the hold current of the thermistor at a temperature T is less than T+35° C., where T≧60° C.

3. The thermistor of claim 1, wherein the crystalline polymer comprises high density polyethylene and low density polyethylene.

4. The thermistor of claim 3, wherein the high density polyethylene comprises 3%-25% by weight of the polymeric material layer.

5. The thermistor of claim 3, wherein the low density polyethylene comprises less than 18% by weight of the polymeric material layer.

6. The thermistor of claim 3, wherein the high density polyethylene has a melting point larger than 115° C.

7. The thermistor of claim 3, wherein the high density polyethylene comprises two kinds of high density polyethylene of different densities.

8. The thermistor of claim 1, wherein the conductive filler comprises metal.

9. The thermistor of claim 8, wherein the metal is selected from the group consisting of nickel, cobalt, copper, iron, tin, lead, silver, gold, platinum, vanadium, and alloys thereof.

10. The thermistor of claim 1, wherein the conductive filler comprises conductive ceramic carbide.

11. The thermistor of claim 10, wherein the conductive ceramic carbide is selected from the group of consisting of titanium carbide, tungsten carbide, vanadium carbide, boron carbide, zirconium carbide, niobium carbide, tantalum carbide, molybdenum carbide, and hafnium carbide.

12. The thermistor of claim 1, wherein the thermistor has a device effective area less than 25 mm$^2$.

13. The thermistor of claim 1, wherein a weight ratio of the polymeric material layer to the crystalline polymer with same volume is between 2.5 and 12.

14. The thermistor of claim 1, wherein the conductive filler comprises 75%-94% by weight of the polymeric material layer.

15. The thermistor of claim 1, wherein the value of the hold current of the thermistor at 60° C. divided by the device effective area is between 0.2 A/mm$^2$ and 0.75 A/mm$^2$.

16. The thermistor of claim 1, wherein the ratio of the hold current of the thermistor at 60° C. to the hold current of the thermistor at 25° C. is between 60% and 90%.

17. The thermistor of claim 1, wherein the TCO temperature on a basis of the hold current of the thermistor at 60° C. is between 65° C. and 85° C.

18. The thermistor of claim 1, wherein the thermistor is connected to a protection circuit module and at least one secondary battery in series or in parallel.

19. The thermistor of claim 18, wherein the thermistor is connected to the protection circuit module and the secondary battery by spot-welding, reflow, supersonic welding or laser welding.

* * * * *